US010814381B2

(12) United States Patent
Jo et al.

(10) Patent No.: US 10,814,381 B2
(45) Date of Patent: Oct. 27, 2020

(54) VACUUM CENTRIFUGAL CASTING APPARATUS

(71) Applicants: Hyundai Motor Company, Seoul (KR); Kia Motors Corporation, Seoul (KR)

(72) Inventors: Young-Rae Jo, Gyeonggi-do (KR); Hyo-Moon Joo, Seoul (KR); Min-Soo Kim, Seoul (KR); Mun-Gu Kang, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 151 days.

(21) Appl. No.: 16/181,852

(22) Filed: Nov. 6, 2018

(65) Prior Publication Data

US 2019/0184455 A1 Jun. 20, 2019

(30) Foreign Application Priority Data

Dec. 15, 2017 (KR) ..... 10-2017-0173371

(51) Int. Cl.
*B22D 13/10* (2006.01)
*B22C 9/06* (2006.01)

(52) U.S. Cl.
CPC ..... *B22D 13/101* (2013.01); *B22C 9/067* (2013.01)

(58) Field of Classification Search
CPC ..... B22C 9/067; B22D 13/026; B22D 13/04; B22D 13/06; B22D 13/10; B22D 13/101
See application file for complete search history.

(56) References Cited

U.S. PATENT DOCUMENTS 4,063,863 A * 12/1977 Hilmoe ..... B29C 39/42 425/425

FOREIGN PATENT DOCUMENTS

JP 59225867 A * 12/1984 ..... B22C 9/046
KR 1374828 B1 3/2014

* cited by examiner

*Primary Examiner* — Kevin E Yoon
(74) *Attorney, Agent, or Firm* — Mintz Levin Cohn Ferris Glovsky and Popeo, P.C.; Peter F. Corless

(57) ABSTRACT

A vacuum centrifugal casting apparatus includes an upper mold having an upper vacuum hole communicating with both a cavity and a space over the upper mold, a lower mold including a lower vacuum hole corresponding to the upper vacuum hole, the lower vacuum hole communicating with both the cavity and a space under the lower mold, a motor configured to rotate the upper mold and the lower mold, a vacuum retaining member having an outer diameter corresponding to the upper vacuum hole, with a molten metal injection hole formed in an upper end of the vacuum retaining member, and a vacuum pump configured to be operated by the motor, and including an inlet communicating with the lower vacuum hole, and an outlet formed to exhaust drawn air.

12 Claims, 12 Drawing Sheets

VACUUM CENTRIFUGAL CASTING APPARATUS

CROSS-REFERENCE TO RELATED APPLICATION(S)

This application claims under 35 U.S.C. § 119(a) the benefit of Korean Patent Application No. 10-2017-0173371, filed on Dec. 15, 2017, the entire contents of which are incorporated herein by reference.

BACKGROUND

(a) Technical Field

The present disclosure relates to a centrifugal casting apparatus, more particularly, to the centrifugal casting apparatus configured to form a vacuum in a cavity.

(b) Description of Related Art

A centrifugal casting process is a casting process of forming a casting in such a way that centrifugal force is applied to molten metal by rotating a mold. In other words, centrifugal force may act uniformly on an entirety of the mold by rotation of the mold so that the casting process may be performed while pressure is applied to the molten metal.

However, in the typical centrifugal casting process, a defect may occur resulting in formation of bubbles in a casting product due to air that is present in a cavity of the mold or vortex currents generated during injection of molten metal.

Process parameters for controlling the defect may include a rotating RPM, a temperature of the mold, a molten metal injection temperature, formation of an air vent, and so forth. However, it is impossible to fundamentally control the amount of gas in the cavity.

In an effort to reduce gas content in the cavity, a vacuum centrifugal casting process was proposed in Korean Patent Registration No. 10-1374828, which can be referred to as 'conventional art'. The conventional art is embodied in a vacuum pump which forms a vacuum in an entirety of space defined by an upper housing and a lower housing which enclose a mold.

The existing vacuum centrifugal casting method according to the conventional art has been applied to a precision casting process for small components, but has a disadvantage in that it is difficult for the existing vacuum centrifugal casting method to be applied to medium and large components due to spatial restriction of an apparatus.

Further, it is inefficient because a vacuum is formed in the entirety of the space including the mold. In addition, since injection of external molten metal is impossible after the vacuum has been formed, there is a disadvantage in that a separate metal melting device or a molten metal storage device is required in the mold.

The foregoing is intended merely to aid in the understanding of the background of the present disclosure, and is not intended to mean that the present disclosure falls within the purview of the related art that is already known to those skilled in the art.

SUMMARY

An embodiment of the present disclosure is directed to a vacuum centrifugal casting apparatus capable of controlling gas content only in a cavity of a mold rather than the entirety of the mold.

In accordance with an embodiment of the present disclosure, there is provided a vacuum centrifugal casting apparatus including: an upper mold including an upper vacuum hole communicating with both a cavity and a space over the upper mold; a lower mold including a lower vacuum hole corresponding to the upper vacuum hole, the lower vacuum hole communicating with both the cavity and a space under the lower mold; a motor configured to rotate the upper mold and the lower mold; a vacuum retaining member having an outer diameter corresponding to the upper vacuum hole, with a molten metal injection hole formed in an upper end of the vacuum retaining member; and a vacuum pump configured to be operated by the motor, and including an inlet communicating with the lower vacuum hole, and an outlet formed to exhaust drawn air.

The vacuum retaining member may include: an internal space formed in a body forming an outer shape of the vacuum retaining member so that molten metal is injected into the internal space through the molten metal injection hole; a molten metal filling hole formed in a first lateral direction in a medial portion of the body; and a gas exhaust hole formed in a second lateral direction in a lower end of the body.

The vacuum centrifugal casting apparatus may further include a retaining-member fixing unit configured to fix the vacuum retaining member at a height at which the gas exhaust hole of the vacuum retaining member communicates with the cavity.

A fixing-member receiving hole may be formed in the upper mold. The retaining-member fixing unit may include: a fixing member disposed in the fixing-member receiving hole and configured to allow a protruding one end of the fixing member to be inserted into a fixing depression formed in the vacuum retaining member; and a spring configured to elastically couple the fixing member to the fixing-member receiving hole.

The vacuum retaining member may move downward as the spring is contracted by centrifugal force generated by rotation of the upper mold and the lower mold.

The vacuum retaining member may move downward when the upper mold and the lower mold rotate at a rotation speed greater than or equal to a casting RPM.

The vacuum retaining member may move downward when the vacuum retaining member is released from the retaining-member fixing unit. A stopper configured to set a downwardly moved position of the vacuum retaining member may be formed in the lower mold.

The vacuum retaining member may be moved downward and disposed at a height at which the molten metal filling hole communicates with the cavity.

In an embodiment, a pair of rod insert holes may be formed in the lower mold. The retaining-member fixing unit may include: a pair of sliding rods respectively disposed in the rod insert holes and configured to operate in a sliding manner; a pair of springs configured to elastically couple the pair of sliding rods to the rod insert holes, respectively; and a pair of rotating rods rotatably coupled to respective ends of the sliding rods. The pair of rotating rods may intersect with each other and be coupled to the lower end of the vacuum retaining member.

The vacuum retaining member may move downward as the springs are contracted by centrifugal force generated by rotation of the upper mold and the lower mold.

The vacuum retaining member may move downward when the upper mold and the lower mold rotate at a rotation speed greater than or equal to a casting RPM.

The vacuum retaining member may be moved downward and disposed at a height at which the molten metal filling hole communicates with the cavity.

DESCRIPTION OF SPECIFIC EMBODIMENTS

Figure 1:
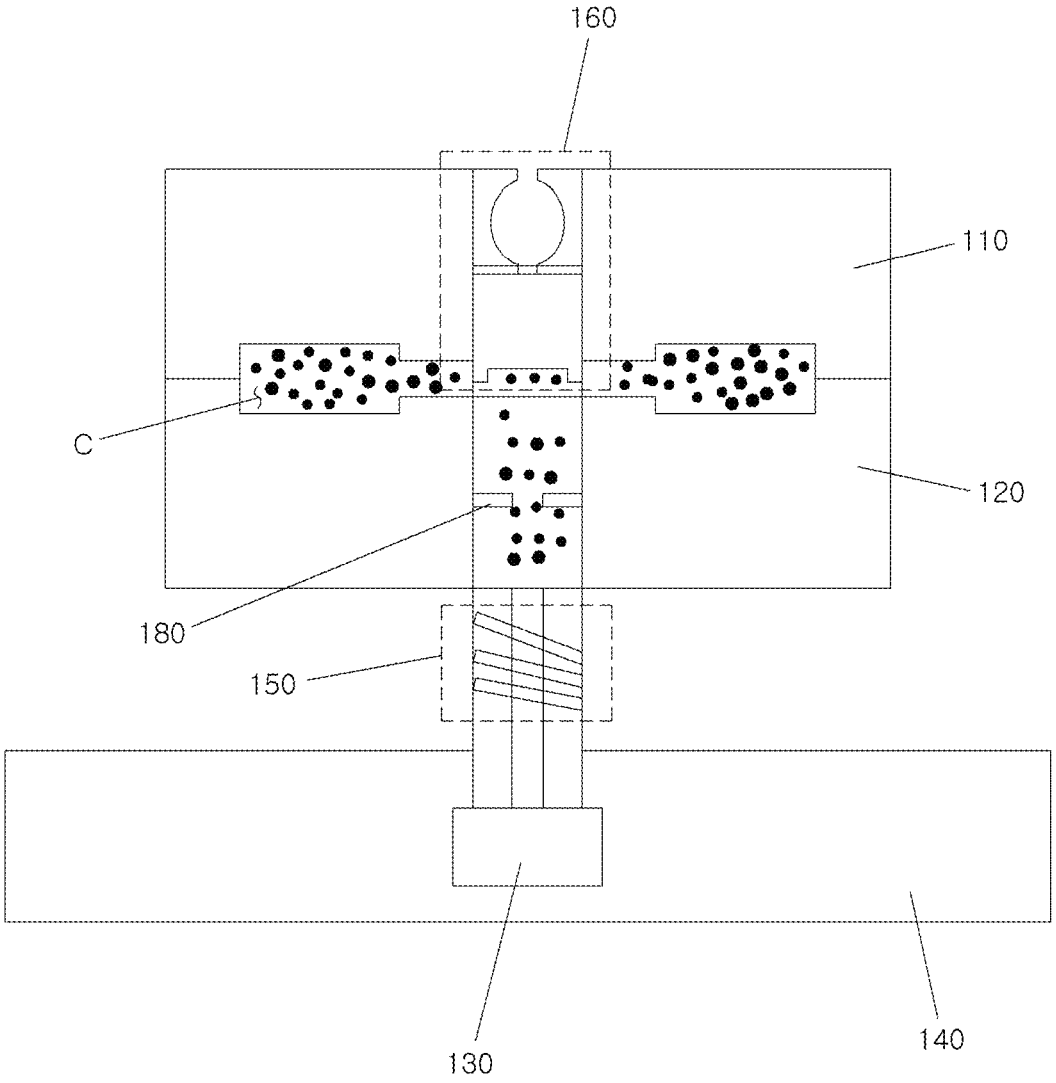
FIG. 1 is a schematic view illustrating a vacuum centrifugal casting apparatus according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Exemplary embodiments of the present disclosure will be described below in more detail with reference to the accompanying drawings so as to make those skilled in the art fully understand operational advantages and objects of the present disclosure.

In the description of preferred embodiments of the disclosure, the description of known technology or a duplicated description may be omitted to avoid obscuring appreciation of the disclosure.

Figure 2A:
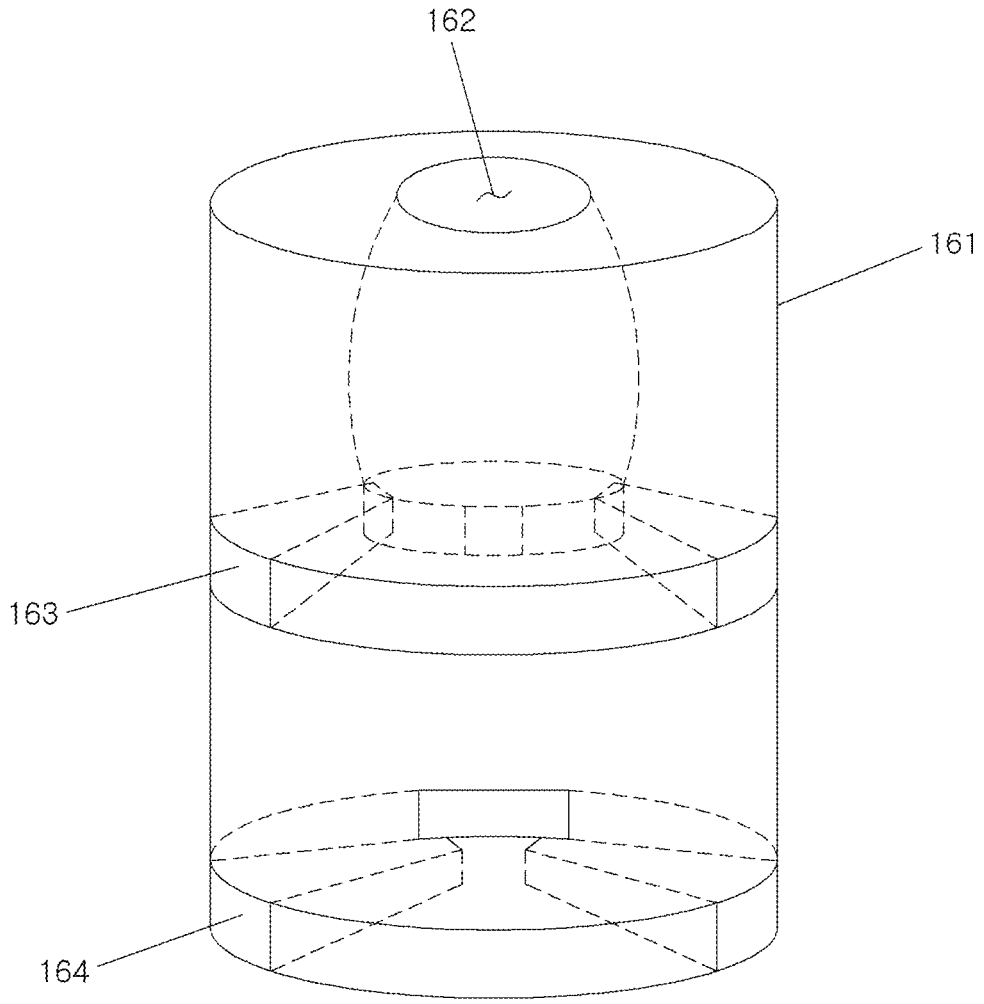
FIG. 2A illustrates a vacuum retaining member of the vacuum centrifugal casting apparatus according to the present disclosure.
Figure 2B:
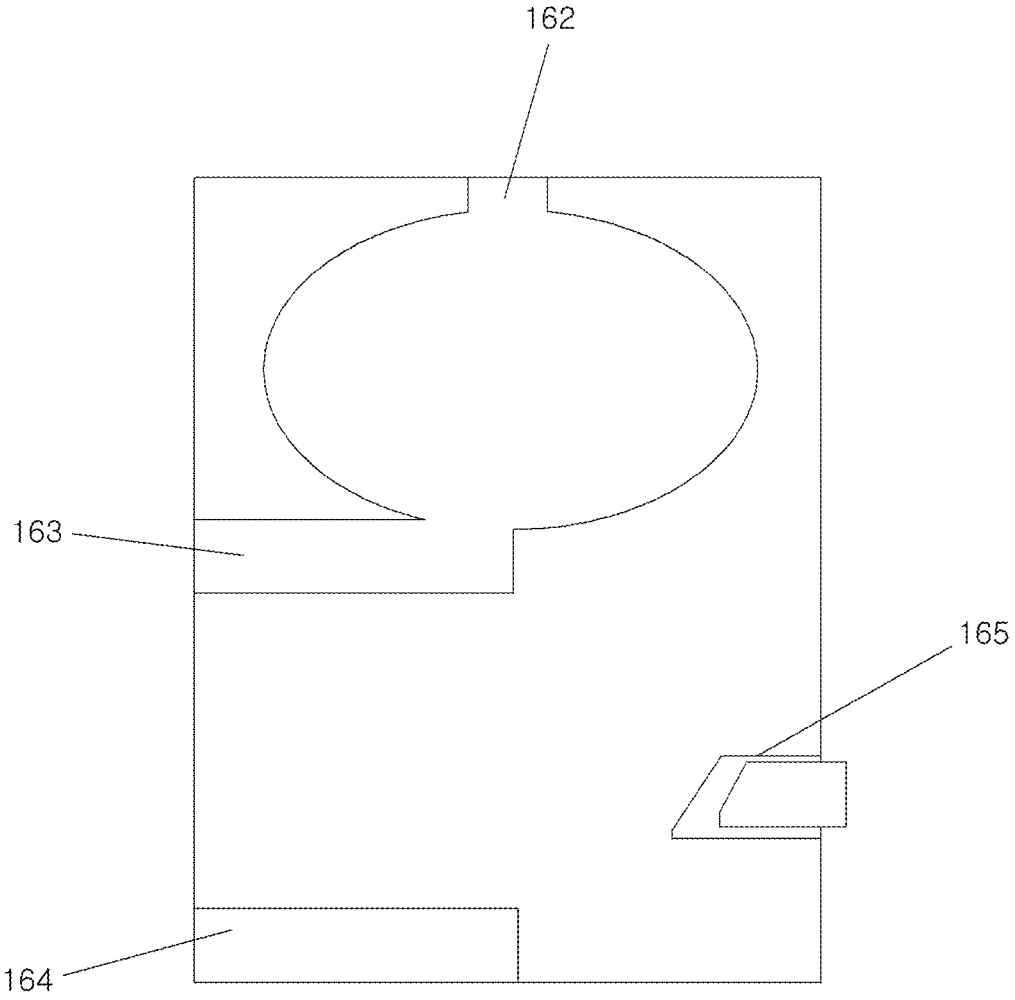
FIG. 2B is a vertical cross-sectional view of FIG. 2A.
Figure 3:
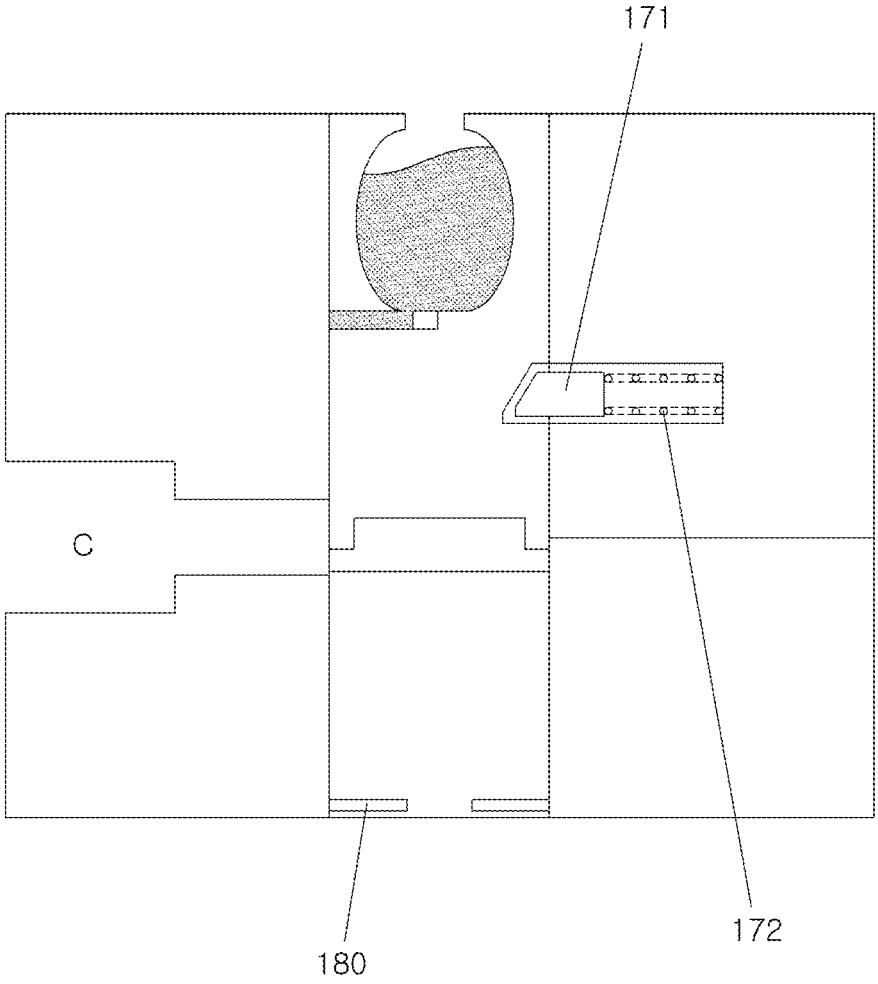
FIGS. 3 and 4 are partial views illustrating the vacuum centrifugal casting apparatus according to the embodiment of the present disclosure.
Figure 4:
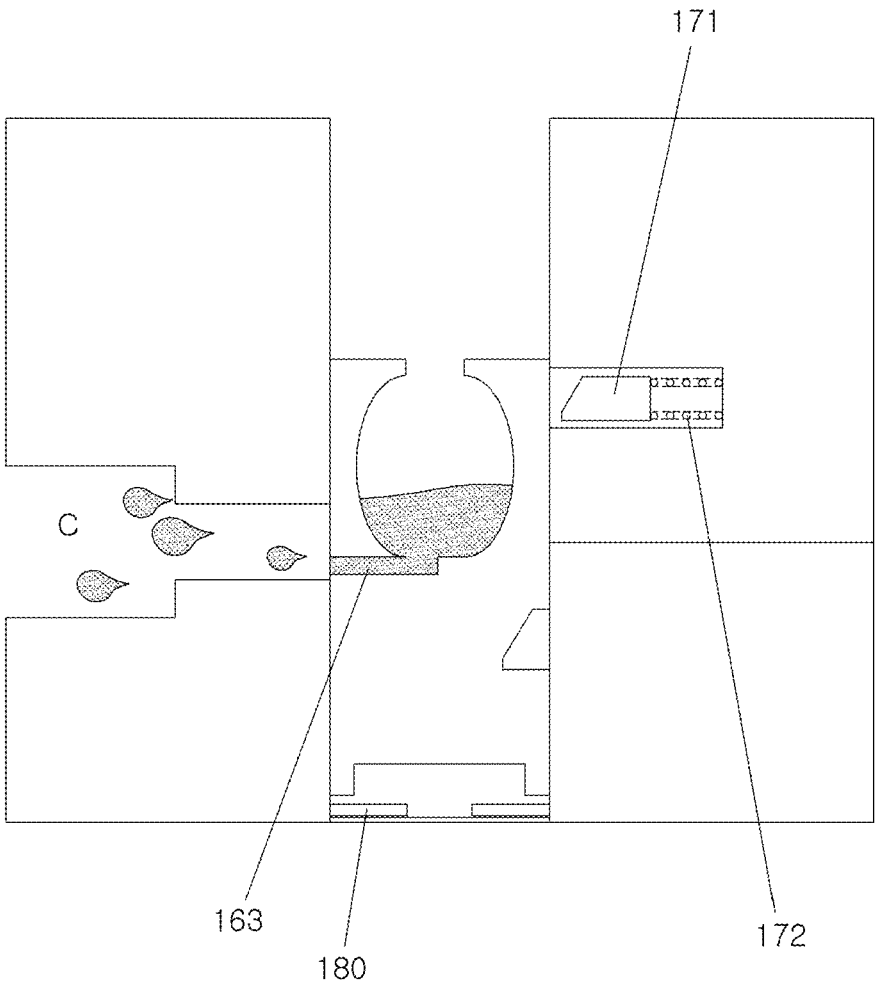

FIG. 1 is a schematic view illustrating a vacuum centrifugal casting apparatus according to an embodiment of the present disclosure. FIG. 2A illustrates a vacuum retaining member of the vacuum centrifugal casting apparatus according to the embodiment of the present disclosure, and FIG. 2B is a vertical cross-sectional view of FIG. 2A. FIGS. 3 and 4 are partial views illustrating the vacuum centrifugal casting apparatus according to the embodiment of the present disclosure.

Hereinafter, the vacuum centrifugal casting apparatus and the vacuum retaining member according to the embodiment of the present disclosure will be described with reference to FIGS. 1 to 4.

The vacuum centrifugal casting apparatus according to the embodiment of the present disclosure is an apparatus, which includes a mold formed of an upper mold 110 and a lower mold 120, and in which the upper mold 110 and the lower mold 120 that are coupled to each other are rotated around a rotating axis by a motor 130 provided on a support base 140 so that pressure is applied to molten metal during a casting process.

The motor 130 is coupled to the lower mold 120 by a shaft so that the lower mold 120 can be rotated by rotation of the shaft. A vacuum pump 150 for forming vacuum in a cavity C in the mold is coupled between the motor 130 and the lower mold 120.

An upper vacuum hole and a lower vacuum hole which respectively open upwardly and downwardly are respectively formed in the upper mold 110 and the lower mold 120 such that the upper and lower vacuum holes communicate with each other. The upper vacuum hole and the lower vacuum hole are formed parallel with the axial direction of the shaft.

The vacuum pump 150 is provided such that an inlet thereof communicates with the lower vacuum hole. An outlet is formed in a lower end of the vacuum pump 150. The vacuum pump 150 is operated by the motor 130 to discharge air out of the cavity C.

A vacuum retaining member 160 is provided in the upper vacuum hole of the upper mold 110.

The vacuum retaining member 160 is formed of a cylindrical body 161 having a diameter corresponding to that of the upper vacuum hole, and has an internal space into which molten metal is injected through a molten metal injection hole 162 formed in an upper end of the internal space.

A lower end of the internal space communicates with a molten metal filling hole 163 formed in a first lateral direction in a medial portion of the cylindrical body 161.

Thus, molten metal injected through the molten metal injection hole 162 remains in the internal space, and then is charged into the cavity C through the molten metal filling hole 163 when the molten metal filling hole 163 communicates with the cavity C.

In addition, a gas exhaust hole 164 is formed in a second lateral direction in a lower end of the body 161.

When the vacuum retaining member 160 is at an initial position, the gas exhaust hole 164 communicates with the cavity C so that air is guided from the cavity C into the vacuum pump 150 through the gas exhaust hole 164.

A retaining-member fixing unit is provided to keep the vacuum retaining member 160 at the initial position.

In the present embodiment, the retaining-member fixing unit includes a spring 172 and a fixing member 171 provided protruding into the upper vacuum hole of the upper mold 110.

The fixing member 171 and the spring 172 are disposed in a fixing-member receiving hole formed in the upper mold 110. When no external force is applied, the fixing member 171 protrudes from the fixing-member receiving hole and is inserted into a fixing depression 165 formed at a corresponding position in the vacuum retaining member 160, whereby the vacuum retaining member 160 is retained at a predetermined height.

Further, a stopper 180 for setting a downwardly moved position of the vacuum retaining member 160 is provided in the lower vacuum hole of the lower mold 120 in such a way that the stopper 180 protrudes into the lower vacuum hole.

Figure 5:
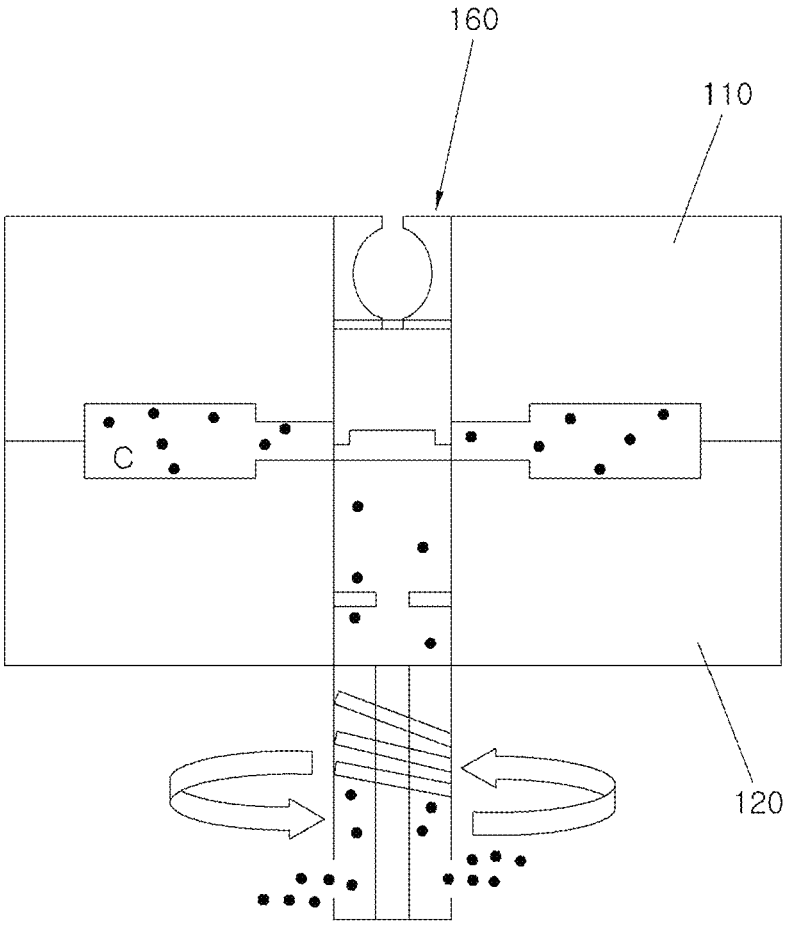
FIGS. 5 to 7 are schematic views illustrating the operation of the vacuum centrifugal casting apparatus according to the embodiment of the present disclosure.

In the vacuum centrifugal casting apparatus according to the present disclosure having the above-mentioned configuration, as shown in FIG. 5, when the motor 130 is operated for centrifugal casting, the upper mold 110 and the lower mold 120 are rotated around the shaft coupled to the motor 130 and, simultaneously, the vacuum pump 150 is operated so that air is discharged from the cavity C to the outside through the outlet of the vacuum pump 150 via the inlet of the vacuum pump 150 that communicates with the lower end of the lower vacuum hole.

Figure 6:
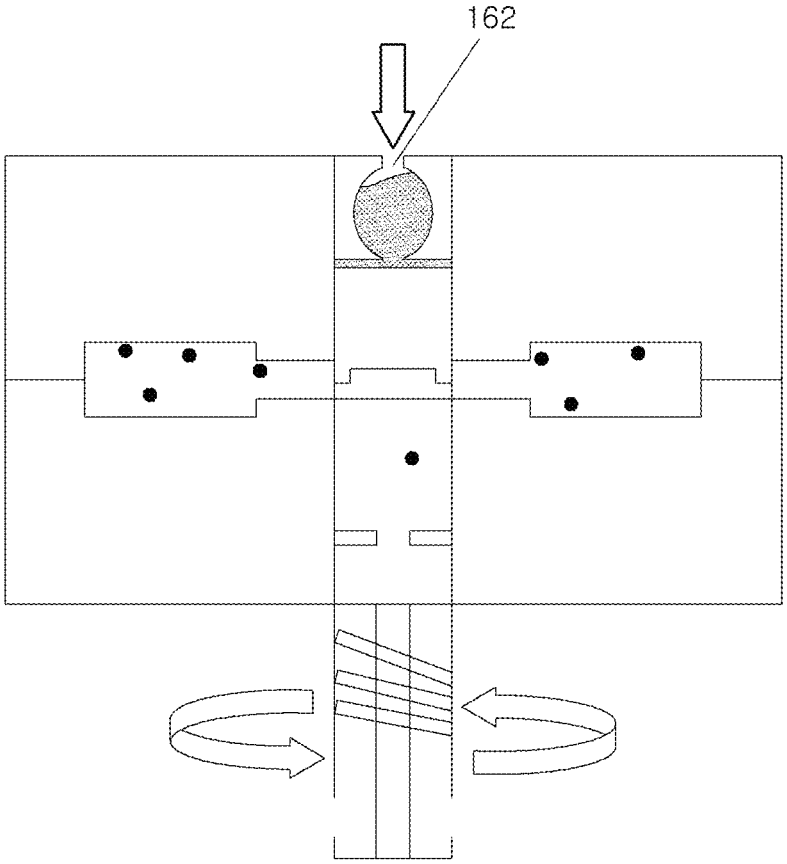
Figure 7:
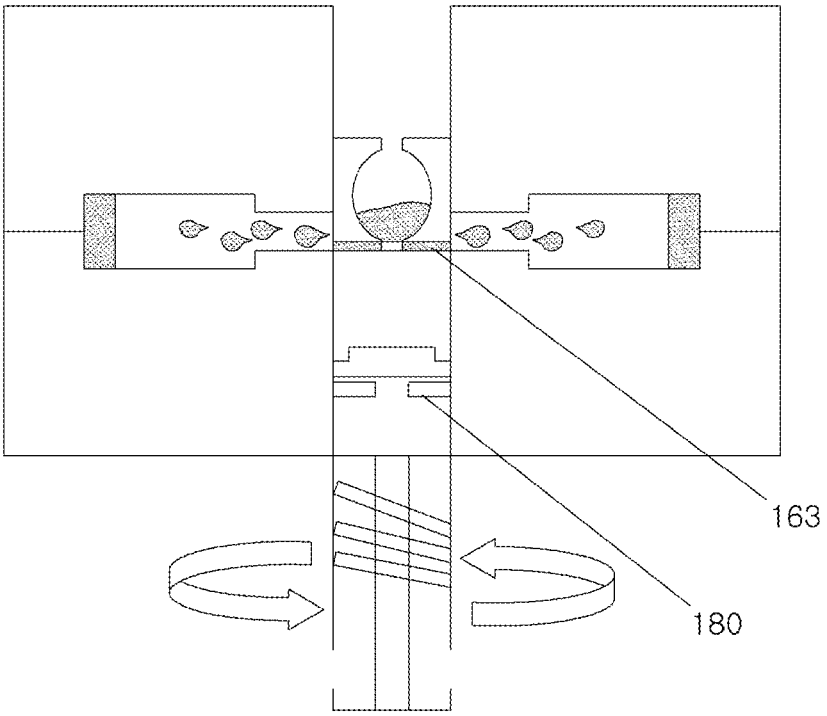

Thus, as shown in FIG. 6, a desired degree of vacuum is formed in the cavity C. Thereafter, molten metal is injected into the internal space of the vacuum retaining member 160 through the molten metal injection hole 162, and then, as shown in FIG. 7, the vacuum retaining member 160 is moved downward.

Since the degree of vacuum in the cavity C can be controlled by the number of revolutions (a rotation time× RPM) of the vacuum pump 150, it is possible for the degree of vacuum to be controlled by adjusting the capacity and rotation RPM of the vacuum pump 150 depending on a desired degree of vacuum.

Thereafter, while the vacuum retaining member 160 moves downward, the cavity C communicate with neither the upper vacuum hole nor the lower vacuum hole, so that the cavity C remains in the vacuum state. When the position of the molten metal filling hole 163 of the vacuum retaining member 160 corresponds to the cavity C, the molten metal is charged through the molten metal filling hole 163 into the cavity C that remains in the vacuum state.

Since the downwardly moved position of the vacuum retaining member 160 is determined by the stopper 180, the molten metal filling hole 163 can be disposed at a position corresponding to the cavity C.

As described above, the vacuum retaining member 160 that has been fixed by the fixing member 171 at the position shown in FIG. 3 is moved to the position shown in FIG. 4 after the molten metal has been injected into the internal space of the vacuum retaining member 160. In particular, the vacuum-retaining-member releasing operation of the fixing member 171 is implemented by centrifugal force.

In other words, the spring 172 is contracted by centrifugal force generated by the rotation of the mold. Thereby, the fixing member 171 is moved away from the fixing depression 165 of the vacuum retaining member 160 and inserted into the fixing-member receiving hole of the upper mold 110, whereby the fixed state of the vacuum retaining member 160 is released.

In particular, a timing at which the vacuum retaining member 160 starts to move downward may be controlled by adjusting the centrifugal force (i.e., adjusting the RPM) depending to a stiffness constant (k) of the spring 172.

Alternatively, the stiffness constant (k) of the spring 172 may be set such that the fixing member 171 is retracted when the rotation RPM reaches a casting RPM, i.e., is greater than or equal to the casting RPM.

The fixing member 171 may have a tapered rod to ensure smooth operation.

The centrifugal casting process using the vacuum centrifugal casting apparatus according to the present disclosure may be divided into a vacuum forming operation shown in FIG. 5, a molten metal injection and fixing member releasing operation shown in FIG. 6, and a molten metal filling and casting operation shown in FIG. 7. The rotation RPM in each operation may be separately set.

That is, it is preferable that the RPM in the vacuum forming operation be set depending on a target degree of vacuum, the RPM in the molten metal injection and fixing member releasing operation be higher than the RPM in the vacuum forming operation, and the stiffness constant of the spring 172 be set to a value corresponding to the foregoing conditions. The reason for this is because the fixed state of the fixing member 171 may be undesirably released during the vacuum forming operation otherwise.

Further, it is preferable that the RPM in the molten metal filling and casting operation be set to a value equal to or greater than the RPM in the molten metal injection and fixing member releasing operation.

Figure 8:
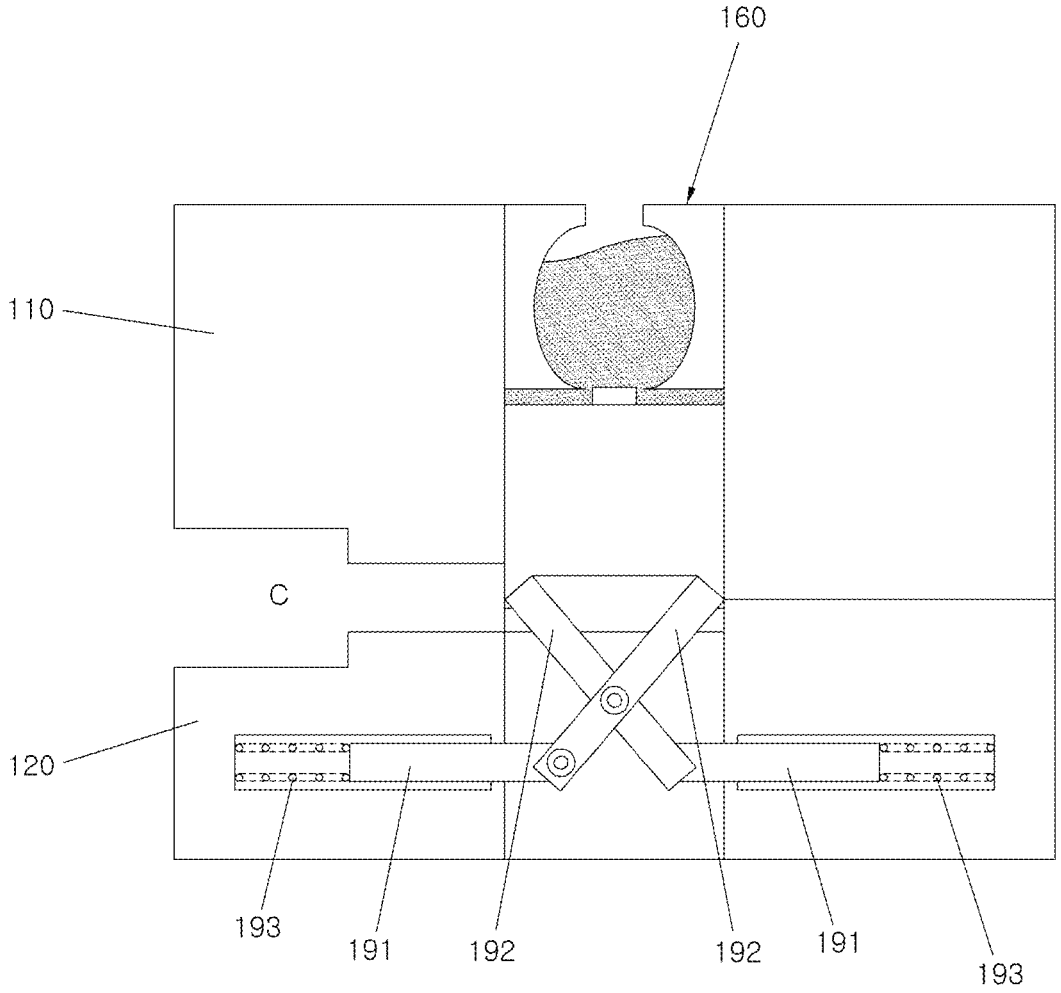
FIGS. 8 and 9 are schematic views illustrating a vacuum centrifugal casting apparatus according to another embodiment of the present disclosure.
Figure 9:
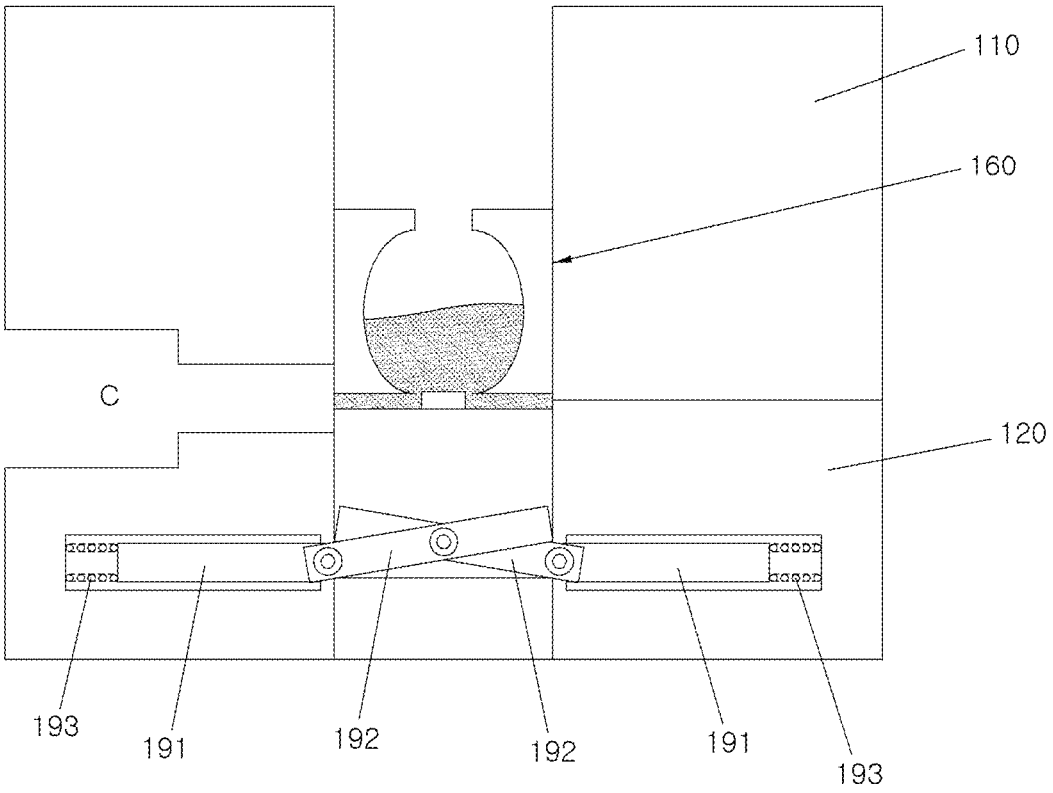

FIGS. 8 and 9 are schematic views illustrating a vacuum centrifugal casting apparatus according to another embodiment of the present disclosure. The vacuum centrifugal casting apparatus according to the present embodiment is different in retaining-member fixing unit from the centrifugal casting apparatus according to the preceding embodiment, and the description of the same technical aspects as those of the preceding embodiment will be omitted.

In the vacuum centrifugal casting apparatus according to the present embodiment, the retaining-member fixing unit for retaining the vacuum retaining member 160 at the initial position or allowing the vacuum retaining member 160 to move downward at a preset timing is formed of a sliding rod 191, a rotating rod 192, and a spring 193. The fixing member 171 or the stopper 180 according to the preceding embodiment is not required.

In particular, a rod insert hole for receiving the sliding rod 191 and the spring 193 is formed in the lower mold 120. In the present embodiment, a pair of sliding rods 191 and a pair of springs 193 are disposed in a pair of rod insert holes.

Each rotating rod 192 is rotatably coupled to one end of a corresponding one of the sliding rods 191. The other end of each rotating rod 192 is coupled to the lower end of the vacuum retaining member 160.

The pair of rotating rods 192 are coupled to each other such that they intersect with each other, thus moving the vacuum retaining member 160 upward or downward as the sliding rods 191 protrude or retract, as shown in FIG. 8 or FIG. 9.

The lengths of the rod insert holes formed in the lower mold 120 and the lengths of the rotating rods 192 are set such that, when the vacuum retaining member 160 moves, the molten metal filling hole 163 is disposed to a position corresponding to the cavity C. The stiffness constant of each spring 193 should be set such that the corresponding sliding rod 191 can be retracted by centrifugal force generated when the rotation RPM reaches the casting RPM.

As described above, in the vacuum centrifugal casting apparatus according to the present disclosure, the centrifugal casting process can be performed while the cavity is maintained in vacuum. Therefore, it is possible to inject molten metal into the cavity, and a bubble formation defect is prevented, whereby the quality of a casting can be enhanced.

Figure 10A:
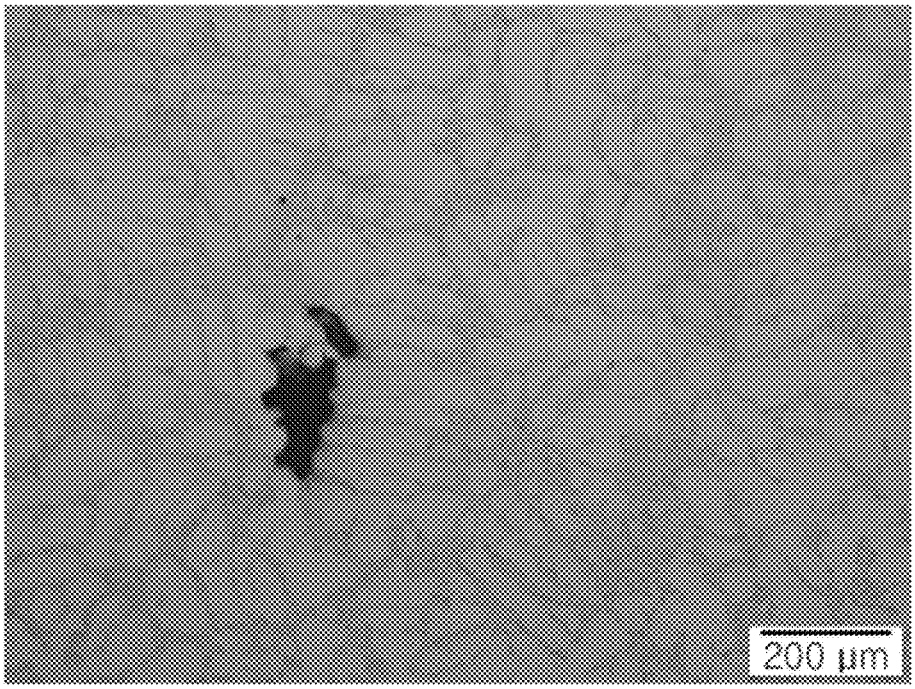
FIG. 10A shows a surface texture of a casting formed through a conventional centrifugal casting process.
Figure 10B:
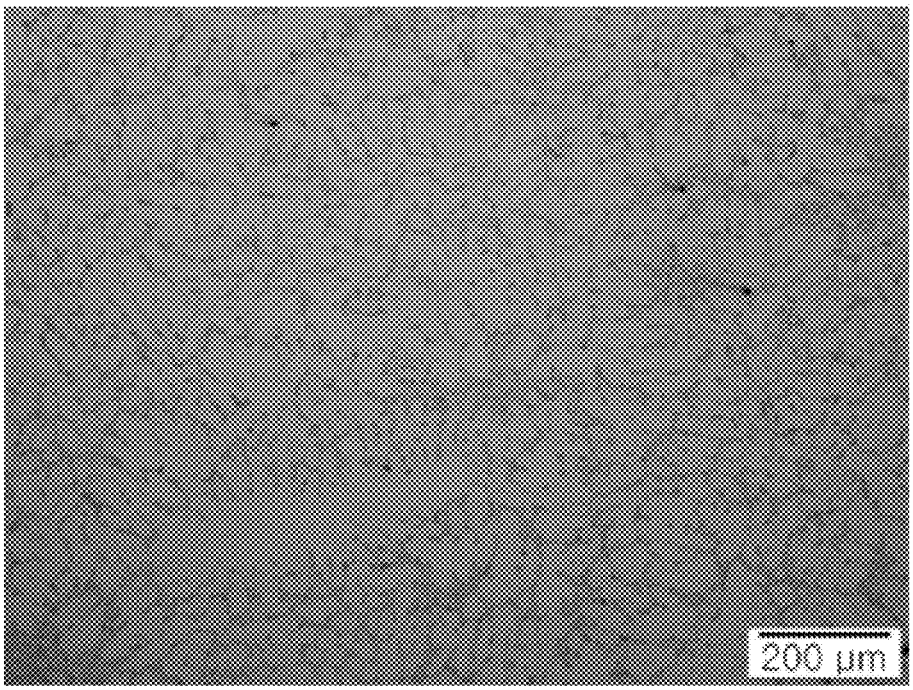
FIG. 10B shows a surface texture of a casting formed according to the present disclosure.

In other words, in the conventional centrifugal casting process, as shown in FIG. 10A, a gas generation defect may be caused in the surface of a casting because gas in the cavity enters the molten metal. However, in a casting formed according to the present disclosure, as shown in FIG. 10B, the gas generation defect can be fundamentally prevented, whereby a high-quality casting can be formed.

As described above, in a vacuum centrifugal casting apparatus according to the present disclosure, gas content only in a cavity of a casting mold rather than the entirety of the mold can be controlled. Hence, it is efficient because equipment can be simplified compared to the conventional art.

Further, oxidation reaction due to contact between molten metal and gas can be restricted by vacuum, whereby a bubble formation defect can be reduced, thus making it possible to manufacture a higher-quality casting.

In addition, because a vacuum is formed in the mold using rotating force during a centrifugal casting process, additional equipment is not required, and thus the centrifugal casting process is more cost effective.

Further, since injection of molten metal from an external holding furnace is possible, use of the existing centrifugal casting equipment is possible.

While the present disclosure has been described with respect to the specific embodiments, it will be apparent to those skilled in the art that various changes and modifications may be made without departing from the spirit and scope of the disclosure as defined in the following claims.

What is claimed is:

1. A vacuum centrifugal casting apparatus, comprising:

an upper mold including an upper vacuum hole communicating with both a cavity and a space over the upper mold;

a lower mold including a lower vacuum hole corresponding to the upper vacuum hole, the lower vacuum hole communicating with both the cavity and a space under the lower mold;

a motor configured to rotate the upper mold and the lower mold;

a vacuum retaining member having an outer diameter corresponding to the upper vacuum hole, with a molten metal injection hole formed in an upper end of the vacuum retaining member; and a vacuum pump configured to be operated by the motor, and including an inlet communicating with the lower vacuum hole, and an outlet formed to exhaust drawn air.

2. The vacuum centrifugal casting apparatus of claim 1, wherein the vacuum retaining member includes:

an internal space formed in a body forming an outer shape of the vacuum retaining member so that molten metal is injected into the internal space through the molten metal injection hole;

a molten metal filling hole formed in a first lateral direction in a medial portion of the body; and a gas exhaust hole formed in a second lateral direction in a lower end of the body.

3. The vacuum centrifugal casting apparatus of claim 2, further comprising a retaining-member fixing unit configured to fix the vacuum retaining member at a height at which the gas exhaust hole of the vacuum retaining member communicates with the cavity.

4. The vacuum centrifugal casting apparatus of claim 3, wherein a fixing-member receiving hole is formed in the upper mold, and wherein the retaining-member fixing unit comprises:

a fixing member disposed in the fixing-member receiving hole and configured to allow a protruding one end of the fixing member to be inserted into a fixing depression formed in the vacuum retaining member; and a spring configured to elastically couple the fixing member to the fixing-member receiving hole.

5. The vacuum centrifugal casting apparatus of claim 4, wherein the vacuum retaining member moves downward as the spring is contracted by centrifugal force generated by rotation of the upper mold and the lower mold.

6. The vacuum centrifugal casting apparatus of claim 5, wherein the vacuum retaining member moves downward when the upper mold and the lower mold rotate at a rotation speed greater than or equal to a casting RPM.

7. The vacuum centrifugal casting apparatus of claim 3, wherein the vacuum retaining member moves downward when the vacuum retaining member is released from the retaining-member fixing unit, and a stopper configured to set a downwardly moved position of the vacuum retaining member is formed in the lower mold.

8. The vacuum centrifugal casting apparatus of claim 7, wherein the vacuum retaining member is moved downward and disposed at a height at which the molten metal filling hole communicates with the cavity.

9. The vacuum centrifugal casting apparatus of claim 3, wherein a pair of rod insert holes are formed in the lower mold, and wherein the retaining-member fixing unit comprises:

a pair of sliding rods respectively disposed in the rod insert holes and configured to operate in a sliding manner;

a pair of springs configured to elastically couple the pair of sliding rods to the rod insert holes, respectively; and a pair of rotating rods rotatably coupled to respective of the sliding rods, wherein the pair of rotating rods intersect with each other and are coupled to the lower end of the vacuum retaining member.

10. The vacuum centrifugal casting apparatus of claim 9, wherein the vacuum retaining member moves downward as the springs are contracted by centrifugal force generated by rotation of the upper mold and the lower mold.

11. The vacuum centrifugal casting apparatus of claim 10, wherein the vacuum retaining member moves downward when the upper mold and the lower mold rotate at a rotation speed greater than or equal to a casting RPM.

12. The vacuum centrifugal casting apparatus of claim 11, wherein the vacuum retaining member is moved downward and disposed at a height at which the molten metal filling hole communicates with the cavity.

* * * * *